United States Patent [19]

Ibrahim

[11] 4,449,374

[45] May 22, 1984

[54] COMBINATION HOT GAS AND AIR DEFROST REFRIGERATED DISPLAY CASE

[75] Inventor: Fayez F. Ibrahim, Niles, Mich.

[73] Assignee: Tyler Refrigeration Corporation, Niles, Mich.

[21] Appl. No.: 397,692

[22] Filed: Jul. 13, 1982

Related U.S. Application Data

[60] Continuation-in-part of Ser. No. 225,997, Jan. 19, 1981, Pat. No. 4,338,792, which is a continuation-in-part of Ser. No. 60,459, Jul. 25, 1980, Pat. No. 4,295,340, which is a continuation-in-part of Ser. No. 8,111, Jan. 21, 1979, Pat. No. 4,329,852, Ser. No. 11,804, Feb. 14, 1979, abandoned, Ser. No. 25,350, Mar. 30, 1979, Pat. No. 4,308,726, Ser. No. 70,882, Aug. 29, 1979, and Ser. No. 308,147, Oct. 2, 1980, which is a division of Ser. No. 145,859, May 1, 1980, Pat. No. 4,314,457.

[51] Int. Cl.[3] ..... A47F 3/04

[52] U.S. Cl. ..... 62/81; 62/256

[58] Field of Search ..... 62/256, 81, 277, 278

[56] References Cited

U.S. PATENT DOCUMENTS

| | | | |
|---|---|---|---|
| 3,122,892 | 3/1964 | Beckwith | 62/278 X |
| 3,147,602 | 9/1964 | Beckwith | 62/278 |
| 3,226,945 | 1/1966 | Spencer | 62/256 |
| 3,499,295 | 3/1970 | Brennan | 62/278 X |
| 4,117,698 | 10/1978 | Vogel | 62/256 |
| 4,144,720 | 3/1979 | Subera et al. | 62/256 |
| 4,285,204 | 8/1981 | Vana | 62/256 X |
| 4,304,098 | 12/1981 | Rydahl | 62/82 |

*Primary Examiner*—William E. Tapolcai

*Attorney, Agent, or Firm*—LeBlanc, Nolan, Shur & Nies

[57] ABSTRACT

A refrigerated display case having a defrost means which combines the supply of hot refrigerant gas to the refrigeration coils with the supply of ambient air in order to provide defrost action during a defrost cycle. The ambient air band is taken into and propelled out of the air conduit in a manner to prevent ambient air from being forced into the product display space in order to avoid thawing of the stored refrigerated products. The defrost air is ejected away from the access opening in order to allow a cold air layer to remain on top of stored products in an open top case. In front cases, a defrost air band is established across the access opening to form a protective air curtain in order to exclude the contacting of the stored products with high temperature and moist ambient air. The ambient air band is unidirectional during the entire defrost cycle. Ejector means are provided for expelling the defrost air band outwardly away from the display space of the case when ejected out of the open top and open front refrigerated cases.

57 Claims, 14 Drawing Figures

FIG. 3
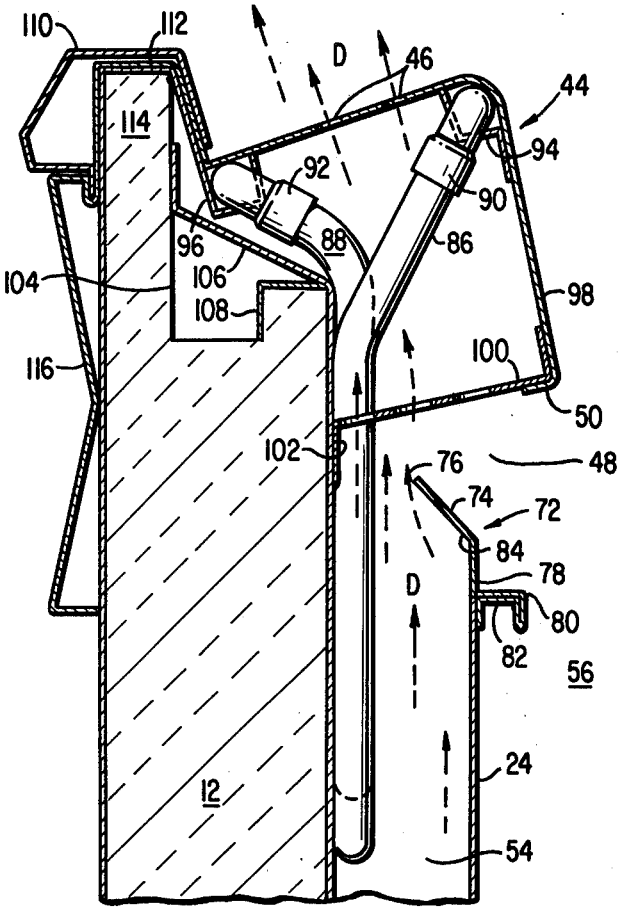
FIG. 6
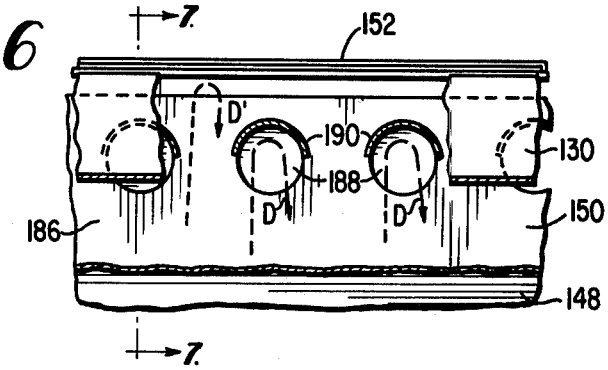
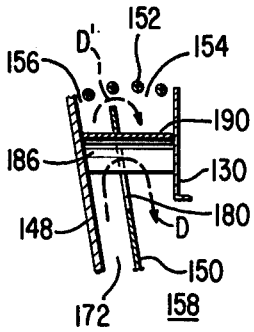
FIG. 7

FIG. 12
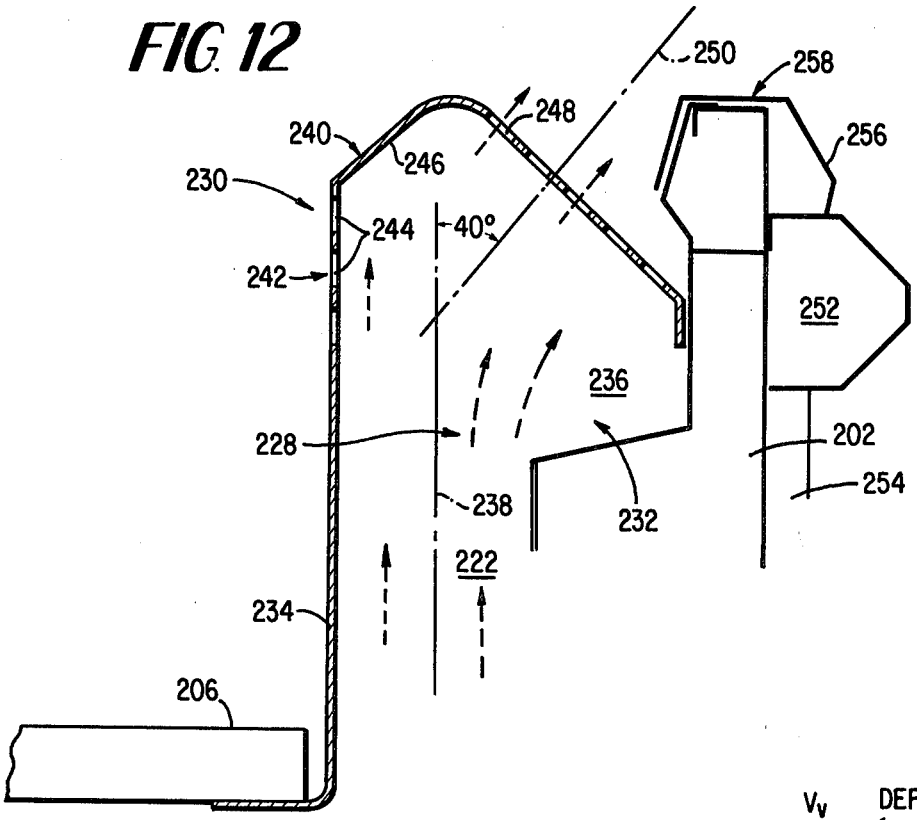
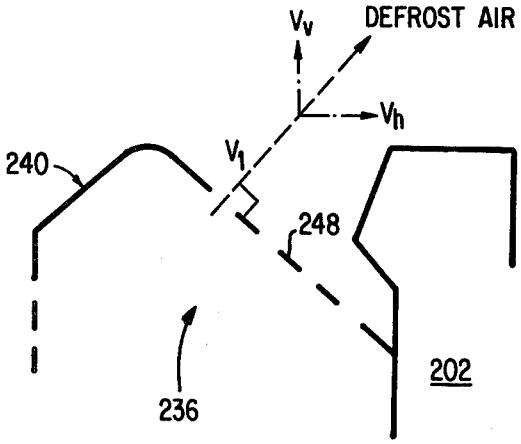
FIG. 13
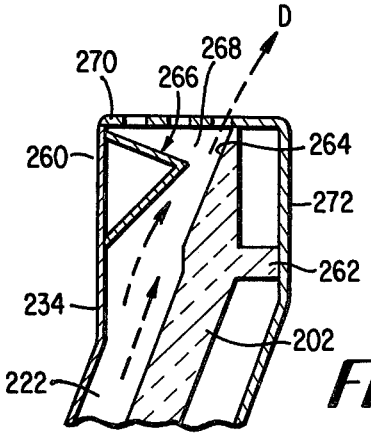
FIG. 14

COMBINATION HOT GAS AND AIR DEFROST REFRIGERATED DISPLAY CASE

RELATED APPLICATIONS

The present application is a continuation-in-part of application Ser. No. 225,997, filed Jan. 19, 1981, now U.S. Pat. No. 4,338,792 which application is, in turn, a continuation-in-part of application Ser. No. 60,459, filed July 25, 1980, now U.S. Pat. No. 4,295,340, which application was, in turn, a continuation-in-part of applications Ser. Nos. 8,111, filed Jan. 21, 1979, now U.S. Pat. No. 4,329,852; 11,804, filed Feb. 14, 1979, now abandoned; and 25,350, filed Mar. 30, 1979, now U.S. Pat. No. 4,308,726; application Ser. No. 70,882, filed Aug. 29, 1979; and application Ser. No. 308,147, filed Oct. 2, 1980, which a division of application Ser. No. 145,859, filed May 1, 1980, now U.S. Pat. No. 4,314,457. The disclosures of all of these applications are hereby incorporated by reference as though fully set forth herein.

BACKGROUND OF THE INVENTION

The present invention relates to a merchandiser type refrigerated display case or cabinet used primarily in retail food and supermarket outlets. More specifically, it relates to a combination refrigerated gas and ambient air defrost means to be employed during the defrosting of such cases in an energy efficient manner.

The term "refrigerated" in accordance with the present invention is intended to incorporate those cases maintained at a temperature at or in excess of 32° F. such as display cases utilized for display of milk and fresh foods, and those cases maintained below 32° F., such as frozen food cases.

In the operation of all types of refrigerated display cabinets, it is desirable to include a system for automatically defrosting the refrigeration coils. The defrost cycle can be actuated either at set periodic time intervals or when the defrost build-up within the system has reached a certain predetermined level. Such systems are typically thermostatically controlled so as to switch from a refrigeration cycle to a defrost cycle of operation. In this manner of operation, it is possible to avoid any significant frost build-up within the display case such that inoperability and spoilage of the stored food products would occur.

There have been three different approaches for defrosting refrigerated display cabinets in this art. These are: utilizing electric resistance heaters; passing a compressed refrigerant gas having a high specific heat through a refrigeration coil; and circulating ambient air through a conduit in which refrigeration coils are positioned. A problem which occurs when using electric resistance heaters or compressed refrigerant gas as the defrosting means is that the heat released in the display cabinets or cases by such means during the defrost cycle can cause food spoilage and/or lesser undesirable changes if not carefully handled. This problem can be largely overcome by defrosting with an incoming ambient air band which is ejected from the case being defrosted in a manner to avoid contacting the stored food products with the ambient air. By use of the ambient air as an external heat source, a more effective defrost can be possible.

Another problem with respect to the use of electric resistance heaters is that these require substantial electric power consumption and are therefore relatively expensive to operate.

The use of ambient air as the defrost medium has a number of advantages including lower operating costs. The ambient air which is substantially warmer than the refrigerated air, is passed over the cooling coils to warm them sufficiently to defrost them. Air defrost utilizes heat extracted from the ambient air in two forms: sensible heat is extracted by dropping the air temperature and latent heat is released in the cooling coil area through the condensation of water vapor in the air. As a rule of thumb, moisture releases about 1300 BTU's per pound when condensed. It has been found that under certain store conditions of temperature and humidity, the air defrost method alone may not be completely adequate to defrost the cooling coils of certain types of frozen food cases rapidly enough to prevent partial defrosting and spoilage of food products stored in the case.

In some environmental conditions, the ambient humidity in the store will be relatively low. Under such low humidity conditions, not enough latent heat can be extracted from the air to defrost the cooling coils in a sufficiently short period of time to prevent the ice cream from melting. It has been found that, at such times, air defrost techniques alone are not completely effective to defrost ice cream containing cases without suffering a certain amount of product spoilage due to the defrosting and refreezing of the ice cream. These types of problems are present for other refrigerated display cases to an extent that additional heat input during the defrost cycle is sometimes considered advantageous.

While the utilization of an ambient air band is the most energy efficient of the three above-described techniques, it is also desirable and economically and commercially necessary to defrost refrigerated display cases quickly to prevent undesirable defrosting of the products stored therein. Applicant's U.S. Pat. No. 4,265,092 discloses and claims a supplemental electric heater mechanism for providing additional heat to the ambient air stream used for defrosting. Another possibility is to utilize a compressed refrigerant gas defrost means to enable heat to be released directly in the refrigeration coil area through the metal walls of the coils whereby a quick defrosting of the frost and ice coating on the coils can be achieved. The combination of a gas defrost means with an ambient air band can result in a highly effective and efficient defrost system. The refrigerant gas produces high heat transfer internal to the coils and the ambient air defrosts other air conduits and drain areas in the cases by use of the lower temperature ambient air. Such a defrost system is usable in a wide range of refrigerated display cases.

Most commercially used refrigerated cases having umimpeded access openings therein are of two types:

1. Open top case having a single air conduit;
2. Open front cases having single or multiple air conduits surrounding the product display space.

When hot gas defrost is used in such refrigerated cases together with an ambient air band defrost, the avoidance of contacting stored products with ambient air becomes even more important because of the elevated temperature of the circulated air band. The prior art has not recognized the importance of this problem and/or has not evolved operative solutions.

One approach to the use of gas defrost means is set forth in U.S. Pat. No. 4,285,204 to Vana. This patent notes that recirculated air can be used to distribute the heat provided by gas defrost within the air conduit. Thus this patent discloses the recirculation of the same air bands in a dual compartment open top case so that the defrost air band is the same as the circulated air band, and hence does not provide for the continuous intake of ambient air. It is stated that the circulation direction of the air bands should be reversed during part of the defrost cycle in order to help defrost certain problem areas which are stated to be the drain areas and the central flue which are heavily frosted during the refrigeration cycle. The flow pattern of air established is such that comingling of ambient air and the recirculated air band over the product display space unavoidably occurs whereby ambient air is moved into contact with the stored products. Further, no unidirectional ambient air band flow through the refrigeration coil means during the entire defrost cycle is established. Also this patent states that the recirculated air path does extend close to the chilled products and loses heat thereto when the case is in a defrost mode.

U.S. Pat. No. 4,320,631 also to Vana describes an auxiliary defrost air discharge mechanism, but does not utilize hot gas defrost, whereby it is limited solely to air defrost.

U.S. Pat. No. 3,383,877 to Liebermann et al discloses the use of hot gas defrost in a refrigerated case which is also provided with air circulation fans; however, these fans are deenergized during the hot gas defrost operation whereby an ambient air band is not generated for providing additional heat input for defrosting. Since no air is circulated during the defrost cycle, there is a reduced occurrence of ambient air coming into contact with stored products, but no combination defrosting takes place.

U.S. Pat. No. 4,026,121 to Aokage et al describes a refrigerated case in which defrosting is accomplished by use of an ambient air band without hot gas defrost energy input. In this patent, the protective air band which prevents moist ambient air from entering the product display space during a refrigeration cycle is terminated during a defrost cycle so that ambient air can come into contact with products stored in this open front case.

U.S Pat. No. 4,120,174 to Johnston discloses an open top case in which a reverse direction ambient air band is utilized for defrosting. There is no disclosure of hot gas defrost to be used in conjunction with this defrost air band. The ambient air band which is ejected from the air conduit in a nearly vertical direction so that the defrost air which often tends to be colder than the surrounding air can fall backward into the open top of the case and thereby entrain ambient air which will come into contact with the stored products.

In distinction to the above-described prior art, the applicant has discovered that a combination of hot gas defrost and an ambient air defrost band can be efficiently employed during defrost cycles in both open top and open front cases providing that means are provided to enable the ambient air band to flow into the air conduit of the refrigerated cabinet and for the defrost air band to exit from the case in a manner so as to prevent ambient air from being forced into the product display space through the access opening. The combination hot gas and the ambient air defrost permits quick defrosting of all parts of the refrigerated case while maintaining refrigerated product quality.

SUMMARY OF THE INVENTION

A refrigerated display case of the type which has an air moving means for propelling an air band through an air conduit therein is provided with a defrost means which combines the supply of hot refrigerant gas to the refrigeration coils and the supply of an ambient air band into the air conduit in order to provide defrost action during the entire defrost cycle. The ambient air band is taken into the air conduit and the exiting defrost air band is removed from the case in a manner to prevent ambient air from being forced into the product display space through the access opening. The defrost means provides for both the supply of hot refrigeration gas and for the supply of ambient air during a defrost cycle in this manner.

The present invention when used in open top cases causes the defrost air to be ejected away from the access opening so as to allow the relatively dense cold refrigerated air layer to remain on top of the stored products. In open front multiple air conduit cases the preferred embodiment is to establish a defrost air band across the access opening to form a protective air curtain in order to exclude the contacting of the stored products with the high temperature and moisture ambient air. In another embodiment, an open front single air conduit case can be provided with a defrost means for ejecting the defrost air away from the access opening so that the refrigerated air above the horizontal shelves of the case is undisturbed.

In order to accomplish defrosting of both open top and open front cases with a combination of hot gas and ambient air defrost a unidirectional ambient air band is established for moveent through said air conduit and about the refrigeration coils during the entire defrost cycle. Such a unidirectional ambient air band then forms a defrost air band by heat exchange with the refrigeration coil means. For open top case this defrost air band is directed away from the access opening and this air flow pattern necessitates reversing the air band flow direction in a single band open top case unless complicated gating and/or air ports are utilized. For open front multiple conduit cases the defrost air band flowing in the inner refrigeration conduit is in the same direction as during the refrigeration cycle so that a protective air band is flowing in an outer refrigeration conduit maintained across the access opening during the defrost cycles.

It is, therefore, an object of the present invention to provide an improvement in refrigerated display cases which have at least one air conduit therein in which a defrost means is provided for enabling the supply of hot refrigeration gas to evaporator coils and the formation of a unidirectional ambient air band for movement through said air conduit and about the evaporator coils during the entire defrost cycle. The air flow into and out of the refrigerated case is provided in a manner to exclude ambient air from entering the product display space.

Yet another object of the present invention is to provide a defrost air ejector means for expelling the defrost air band outwardly away from the display space in order to avoid comingling ambient air with the stored products.

Another object is to provide for a refrigerated display case a defrost means for enabling the supply of a unidirectional ambient air band into an air conduit in order to transfer heat from the ambient air band to the interior of the air conduit.

Yet another object of the present invention is to provide, for a multiple air conduit refrigerated display cabinet, a defrost means for propelling a unidirectional ambient air band through an air conduit in the case and for propelling a secondary air guard band across an access opening of the case during a defrost cycle.

Another object of the present invention is to provide a method of defrosting a refrigerated display case in which an ambient air band is moved into an air conduit within the case and a defrost air band is ejected from the case in a manner to avoid contacting of the stored refrigerated products by the surrounding ambient air.

These and other objects will be understood from the Description of the Invention contained herein.

BRIEF DESCRIPTION OF THE DRAWINGS

FIG. 3 shows a detailed view of the air ejector mechanism which can be used for the case illustrated in FIGS. 1 and 2;

FIG. 6 shows a detailed schematic view of the ambient air band guidance mechanism contained within the refrigerated case shown in FIGS. 4 and 5;

FIG. 7 is a schematic cross-sectional view of the guidance mechanism shown in FIG. 6 taken on line 77;

FIG. 12 is a schematic cross-sectional view of a modified form of an air ejector mechanism for use according to the present invention;

FIG. 13 is a schematic representation of the ejector mechanism fo FIG. 12 showing a vector diagram for the defrost air band flow;

FIG. 14 shows a schematic cross-sectional view of another form of an air ejector mechanism according to the present invention for use on open front cases.

DETAILED DESCRIPTION OF THE PREFERRED EMBODIMENTS

Figure 1:
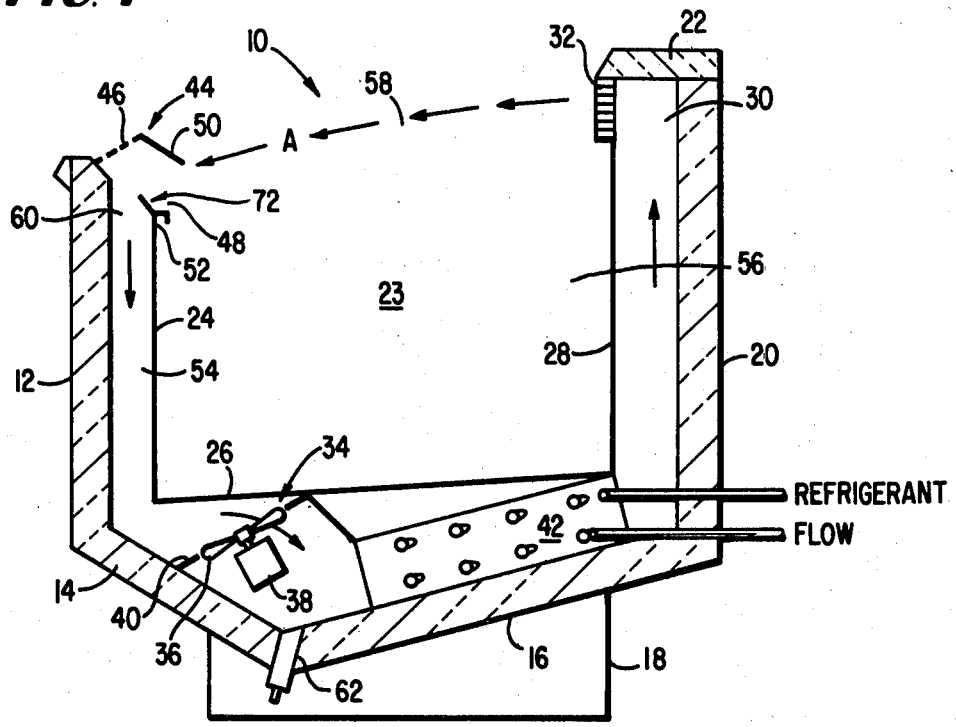
FIG. 1 is a schematic cross-sectional view of an open top refrigerated case during a refrigeration cycle.

FIG. 1 shows an open top refrigerated display cabinet 10 having a front wall 12 which is connected along the lower edge thereof to a front inclined bottom wall 14. A rear portion bottom wall 16 is connected along the rear edge of bottom wall 14 in order to form a shallow V-shaped bottom structure which rests on support 18. A rear wall 20 is connected to the rear edge of bottom wall 16 and has a top forward extended lip 22 resting horizontally thereon. The outer walls 12, 14, 16, 20 and 22 are insulated in order to protect the refrigerated air band contained within the display cabinet 10 from excessive heat transfer from the outside ambient air. The cabinet has two end walls illustrated by one end wall 23.

A front inner panel 24 is spaced from and is positioned generally parallel to front wall 12. The bottom edge of inner partition 24 is connected to an inner bottom panel 26 which is, in turn, connected along its rear edge to rear inner panel 28. An air outlet and inlet opening 30 is formed by the cooperation of rear wall 20, horizontal lip 22 and rear inner panel 28. Horizontally directed louvers 32 are positioned contiguous to opening 30.

An air moving means 34 is located between bottom walls 14 and 16 and inner bottom panel 26. This means 34 consists of a fan 36 and a powering motor 38 which are supported by a bracket panel 40. Also positioned below bottom panel 26 is a set of refrigeration coils 42 which is designed to allow air passage therethrough as shown by the flow arrows.

An air grille 44 is positioned at the top edge of front wall 12 and has perforations 46 located therein to permit the out flow of air. The air grille 44 is constructed to form an opening 48 between its lower most inner lip 50 and the top edge 52 of the front inner panel 24. The outer walls and the inner walls of the cabinet 10 form an air conduit 54 in which an air band can be circulated by the air moving means 34. Motor 38 is reversible so that the air band can be circulated in both directions within air conduit 54 as shown by the flow arrows.

During a refrigeration cycle the air band is circulated in a counterclockwise direction as shown by the solid line arrows A. This air stream then refrigerates the product display space 56 which is surrounded by the inner panels.

During the refrigeration cycle the air moving means 34 circulates air band A through the air conduit 54, into contact with the refrigeration coils 47 in which the refrigerant evaporates, and across the access opening 58 defined by the top portion of the case 10. Air band A flows under the lower lip 50 of the air grille 44 and into an air inlet 60 located at the top of the left side of air conduit 54.

It is normally desirable in food market stocking practices to present the stored products at the highest possible level in the open top cases, hence, the stored products are in physical contact with the air stream passing over the access opening 58.

Figure 2:
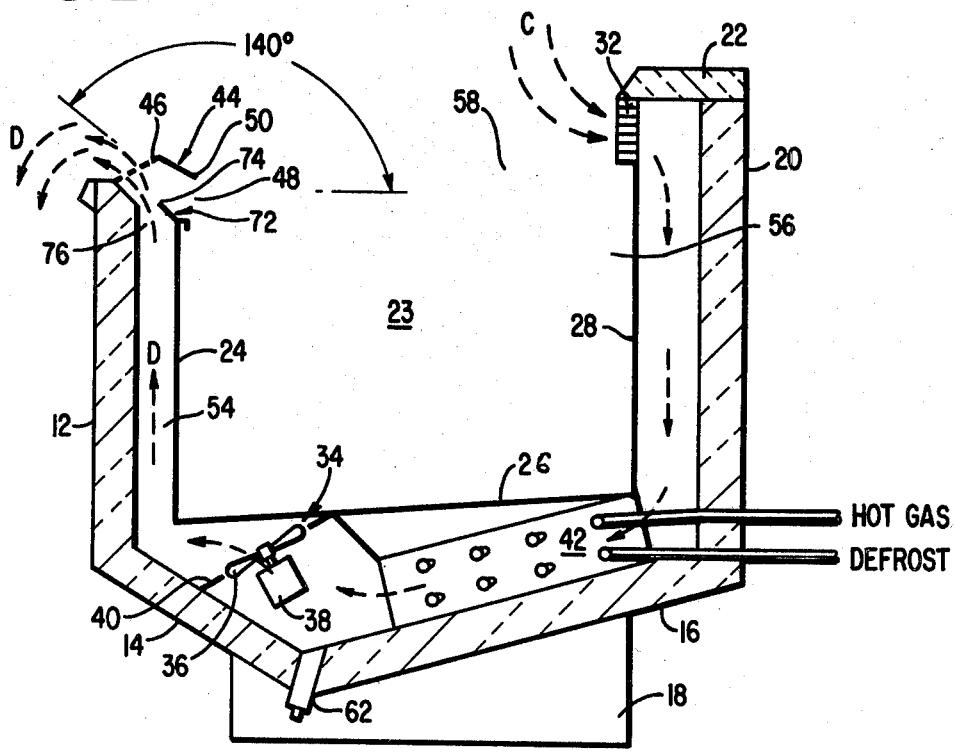
FIG. 2 shows the case of FIG. 1 in a defrost cycle according to the present invention.

Referring now to FIGS. 2 and 3, the open top case 10 is shown during a defrost cycle in which the evaporation flow of refrigerant in the refrigeration coils set 42 is terminated and hot gas from the compressor(s) is put through the coil set 42 to achieve a rapid defrost. The direction of rotation of the air moving means 34 is also reversed to that an ambient air band C is circulated in a clockwise direction through the air conduit 54. Ambient air is drawn in from the air space above the cabinet 10 and propelled through the conduit 54 whereby the warmer ambient air helps to cause the ice and frost accumulated on the coils in coil set 42 to melt and drain through a bottom drain 62. After passing through the air moving means 34 the defrost air band D flows upwardly in the left hand portion of the conduit 54 and passes through the air grille perforations 46 and is ejected away from case 10. To provide for this ejection of the defrost air band, an air flow restriction baffle 72 is affixed along the upper edge of inner front panel 24. The flow area of the air conduit 54 for a cabinet 12 feet in length is approximately 1.5 square feet since the width of the conduit is 1.5 inches. This cross-sectional area within conduit 54 is defined as a 100% cross-section. The air flow restriction baffle 72 is preferably constructed to reduce the air flow cross-section at its upper most lip portion 74 to an approximately 60% cross-section of the area of the air conduit immediately upstream or to an area of 0.9 square feet. Hence, the distance between the upper lip 74 and the inside surface of front wall 12 at the restricted flow area 76 is approximately 0.9 inches.

The air volume passing through the unrestricted portion of the air conduit 54 is defined by the following equation:

$$Q=A\times V \qquad \text{(Eq. 1)}$$

where, Q is the volumetric flow in cubic feet per minute; A is cross-sectional area in square $ft^2$; and V is air velocity in feet per minute.

The air velocity, $V_1$, of the ambient air band stream C circulated by the air moving means 34 can be approximately 200 feet per minute for purpose of such calculations. Since the volumetric flow rate, Q, will remain equal at the point of the air moving means 34 and through the restricted flow area 76, the velocity of the defrost air band passing through the restriction baffle 72, $V_2$, can be calculated as follows, without a adjustment for the increase in velocity caused by the heat provided by coil set 42 operating in defrost:

$$Q = A \times V_1$$
$$= 1.5\ ft^2 \times 200\ fpm$$
$$= 300\ ft^3 \text{ per minute through the air conduit 54}$$

$$V_2 = \frac{Q}{A} = \frac{300}{0.9} = 333.34 \text{ ft per minute through the flow area.}$$

Thus, restricting the flow area from 100% in the conduit to a 60% area illustrated by restriction area 76, results in a reduction in area of 40% and increases the air flow velocity from 200 feet per minute to 333.34 feet per minute. This is a linear velocity increase of 66%. This linear air velocity increase thus increases the momentum of the air stream according to the equation:

$$\Delta M=m\times(V_2-V_1) \qquad \text{(Eq. 2)}$$

where, ΔM=change in momentum in pound×minutes; m=mass of air in(pounds×minutes$^2$)/feet and is obtained by dividing the weight of a given air volumn by the gravitational constant expressed in consistent units; and $V_2$ and $V_1$ are the velocities in feet per minute. The increased momentum in the air band D is then sufficient to cause the air band to be substantially fully propelled upward through air grille 44 and then to the outside of the front of the cabinet 70. This increased velocity and hence momentum then prevents a rearward moving slip stream of defrost air from flowing across the access opening 58 and contacting the displayed products stored in the cabinet as illustrated by FIG. 7. This also permits the cold air mass from the refrigeration cycle to remain in place on top of the stored products during a defrost cycle to remain in place on top of the stored products during a defrost cycle whereby ambient air is excluded from contacting the stored products.

During the terminal portions of the defrost cycle the heat added by the hot gas containing coil set 42 causes the air to expand and hence achieve an even higher defrost air band ejection velocity, $V_2$, equivalent to an additional linear velocity increase of 10 to 20% over the 66% calculated above.

The construction, mode of operation, and result of using the air flow restriction baffle 62 is a subtle yet effective mechanism for preventing the above-described problem of thermal shock and spoilage of refrigerated food products stored in open top cabinets of the type described with respect to FIGS. 1 and 2.

It is also possible to use an air flow reduction cross-section of approximately 80% of the area of the air conduit 54 and hence to have the restriction area 76 equal to about 1.2 $ft^2$. In the above described example of a cabinet 12 feet in length, this would represent a gap distance of 1.2 inches. In such a case, the air band velocity would be increased by about 40% since the relationship of the flow area to the velocity tends to be inversely proportional over a wide range of cross-sectional areas according to the above equations.

A plurality of air moving means 34 illustrated by fan 36 and reversible motor 38 are spaced along the length of cabinet 70 shown in FIG. 2. For example, two each of these fans are normally provided for an eight foot long case or three each of fans are provided for a twelve foot case. By way of example, but not limitation, the overall height of cabinet 10 is approximately 33 to 40 inches and the width ranges from 41 to 55 inches. Such cabinets are manufactured in various lengths.

FIG. 3 shows an enlarged fragmentary view of the top portion of front wall 12 and inner front panel 24 with the preferred air flow reduction baffle 72 mounted thereon for reducing the air flow cross-section from the 100% area of 1.5 $ft^2$ which exists in conduit 54 to approximately 60% at the restriction flow area 76. As the air band D passes through the restriction area 76 the velocity increases approximately 66% and thus the momentum also increases whereby the resulting defrost air band D is propelled upwardly through the air grille 44, and through openings 46 located therein and thus passes outwardly away from the access opening 58 as shown in FIG. 2.

The simplicity of construction of the restriction baffle 72 can be more fully appreciated in FIG. 3 wherein the baffle is formed of a short vertical section 78 which is integrally joined to an L-bracket 80. This L-bracket is designed to be clipped onto an inverted U-shaped channel member 82 which is affixed to the top most portion of inner panel 24. In this manner, the restriction baffle 72 can be clipped to the existing inner panel construction without extensive modification of the internal portions thereof. The remainder of the restriction baffle 72 consists of an inclined upper portion 84 which effectively reduces the air passage area as above described. This simple construction of restriction baffle 72 shows that uncomplicated, yet efficient energy conserving improvements can be discovered to enhance the operation of air defrosted refrigeration display cabinets.

Other details shown in FIG. 3 are the first and second refrigerant gas heater lines 86 and 88 which are shown having elbows 90 and 92 respectively which can be in the form of horizontal portions of the refrigerant gas heater lines 86 and 88 are held in place under the air grille 44 by brackets 94 and 96 respectively. Air grille 44 is shown with perforations 46 on the upper surface thereof. A solid inner panel 98 depends from the upper surface and connects with an optional lower perforated plate 100 near the bottom lip 50. The opposite end of perforated plate 100 is attached to the inside surface of front wall 12 by a depending lip 102. The upper end portions 104 of front wall 12 is configured to permit a close fitting of the air grille 44 and the enclosed refrigerant gas heater lines 86 and 88. An inclined top panel 106 is provided for connecting the inverted U-shaped inner portion 108 of the top of front wall 12 with the outermost portions of wall 12. A rub rail 110 is provided for overlying the top portion of the air grille connecting structure 112 and the upper end 114 of front wall 12. A decoration panel 116 shown with a broad V-shaped indentation is located immediately below the rub rail 110. The product display space 56 is shown to the immediate right hand side of the fragmentary view shown in FIG. 3.

The air flow restriction baffle 72 can be constructed to reduce the cross-sectional flow area of the air conduit to various percentages ranging from 50% to 90% of the unrestricted area. Cross-sectional reductions of these percentages allow air velocity percentage increases ranging from about 100% to about 10%, respectively, at volumetric flow rates close to 300 $ft^3$ per minute (CFM).

The defrost ambient air stream can be circulated through conduit 54 by the air moving means 34 at various volumetric flow rates of from about 200 to 350 CFM. These flow rates are 25% to 50% lower than those used during the refrigeration cycle. Thus typical refrigerated air band volumetric flow rates can range from about 250 CFM to 525 CFM. Preferable flow rates during refrigeration cycle are between 374 CFM to 450 CFM. Preferable flow rates during refrigeration are about 250 CFM to 350 CFM.

During the refrigeration cycle, the air band propelled from air outlet 30 is preferably between 17° F. and 27° F. in a medium temperature display case. The air as received by inlet opening 48 under the air grille 44 is approximately 10° F. to 12° F. higher than the air emitted from the air inlet and outlet opening 30.

As shown by FIG. 2, the construction of air grille 44 permits the refrigerated band to flow horizontally through opening 48 and then the flow of the defrost air band vertically through the perforated upper panel 46 during the defrost cycle. By this construction the air grille facilitates a two directional air flow pattern wherein the axes of the flow openings are positioned from about 90° to 140° of one another. This construction coacts with restriction baffle 72 to permit the air bands circulated during the refrigeration and the defrost cycles to be handled in a separate energy efficient manner since the defrost air band then remains substantially out of contact with the stored refrigerated products.

Referring now to FIGS. 4–9, an upright refrigerated display cabinet or case assembly of preferred form is generally indicated at 120, and comprises display space 122 defined by an upper panel 124, a bottom panel 126, and a rear panel 128 extending in a generally upright direction between the top and bottom panels. Extending upwardly a short distance from bottom panel 126 is a display section front panel 130. Display space 122 is bounded on the sides by a pair of end walls (not shown) and an access opening 132. Shelves (not shown) may be mounted, preferably adjustably, on suitable uprights fixed to or made an integral part of rear wall 128, in a conventional manner.

Figure 5:
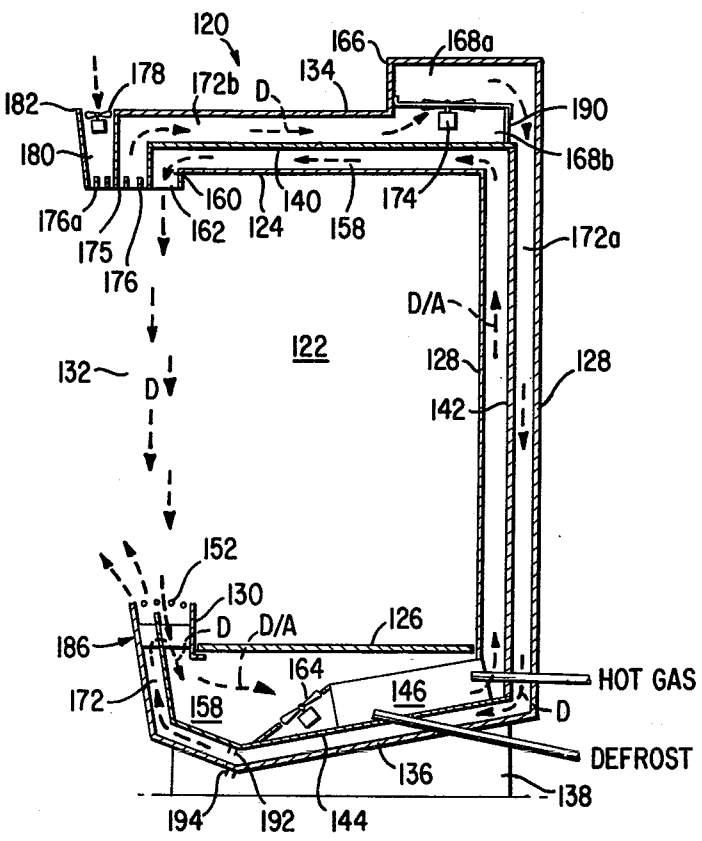
FIG. 5 shows the case of FIG. 4 in a defrost cycle according to the present invention.

Display case 120 contains a defrost means by which combined ambient air and hot gas defrost can be carried out in an advantageous manner in order to exclude ambient air from coming into contact with products stored in the display space 122. A defrost air band, D, shown in FIG. 5 is used as part of the defrost means to exclude the ambient air. Since this air band D is formed by defrosting of the evaporator coils it is usually of lower temperature than the ambient air and hence provides for maintaining the refrigerated condition of the stored products.

Intermediate cabinet top 134 and display area top 124 in the space therebetween is an upper divider panel 140. Located in the space between case back wall and display area back wall 128 is a vertical panel 142 extending vertically from the rear of upper panel 140.

A bottom separator panel 144 is located in the space between case bottom 136 and display bottom 126, closer to case bottom 136. A set of conventional evaporation coils 146 is advantageously located in the space between display bottom 126 and bottom separator panel 144.

A front outer cabinet panel 148 extends from the front of case bottom 136 in a generally vertical direction. Front panel 148 extends up from the floor approximately 24–30 inches. By way of example, but not limitation, the overall height of the refrigerated cabinet (back) may be 81½ inches, overall height (front) 78 inches, overall depth, 45¼ inches, display front opening height 46 inches and overall length 8–12 feet.

Intermediate front cabinet panel 148 and the front display section panel 130 is an upwardly extending separator panel 150 which extends from and is a continuation of bottom separator panel 144. An air grille 152 extends along the bottom edge of access opening 132 between panels 130 and 148, defining inlets 154 and 156 of primary and secondary air band conduits, respectively.

Display section panels 130, 126, 128 and 124, on the one hand, and separator panels 150, 144, 142 and 140, on the other hand, define between them an inner refrigerated air flow conduit 158 extending from inlet 154 substantially along the entire length of the case around and adjacent the bottom, back and top of display area 122 to an outlet 160 containing downwardly oriented directional louvers 162. A plurality of motor driven fans 164 (preferably two each for 8 foot cases, or three each for 12 foot cases) are spaced apart across the width of the case and are mounted in a baffle plate 166 preferably located upstream of evaporating coils 146 (as shown). Fans 164 act as air propulsion means to circulate air drawn into inlet 154, through conduit 158, including refrigeration coils 146, through outlet 160 and down across the open front of the display case, as indicated by arrows A, and back into conduit 158 through inlet 154 to be recirculated.

A housing 166 extending upwardly from the rear portion of cabinet top panel 134, as shown, defines a secondary air band plenum 168. An L-shaped baffle 170 divides plenum 168 into two subchambers **168*a* and 168*b* which communicate with subconduit portions 172*a* and 172*b* of secondary air band conduit 172. A plurality of reversible secondary band fans 174, preferably corresponding in number to primary air band fans 164, are mounted in L-shaped baffle 170. Secondary air band plenum 168 comprises a portion of a secondary air band conduit 172 generally defined between outer case panels 134, 128, 136 and 148, on the one hand, and separator panels 140, 142, 144 and 150** on the other hand.

It will be understood that the construction thus far described extends substantially across the entire width of the refrigerated cabinet.

In the refrigeration cycle, fans 174 act as air propulsion means to constantly circulate air drawn into conduit 172 through inlet 156, through subchambers 168*a* and 168*b*, subconduit 172*b* and out through an outlet 175 normally containing downwardly oriented directional louvers 176, to flow air downwardly across the front of display space 122 toward inlet 156. This creates a secondary air band, indicated by arrows B, outwardly of the primary refrigerated air band, designated by arrows A. The secondary air band forms a protective guard curtain of air contiguous with the primary refrigerated inner air band across the open case front to prevent infiltration of ambient room air into the display area 12. During normal refrigeration operation, the temperature of the recirculated secondary air band through conduit 172 is at a temperature somewhat higher than the temperature of the primary refrigerated air band but below ambient temperature.

Figure 4:
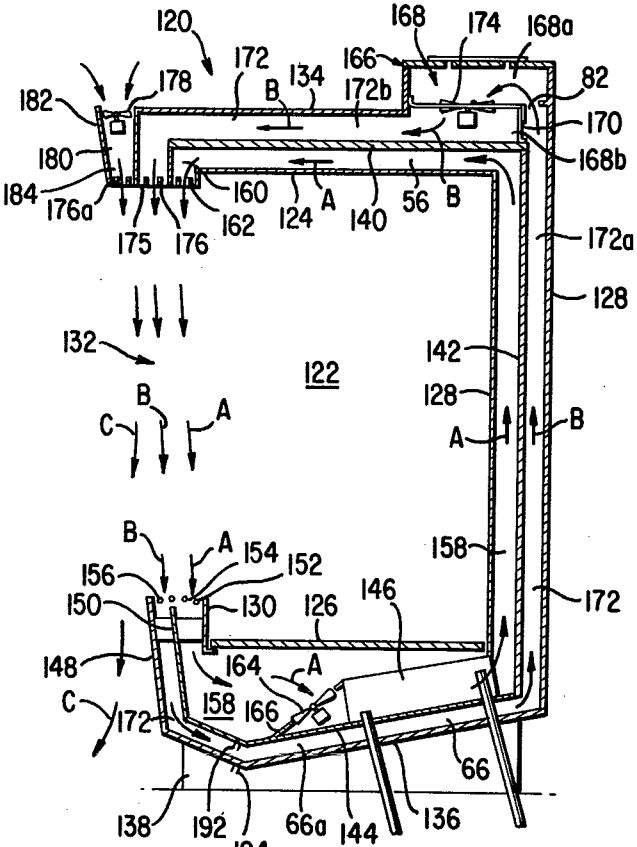
FIG. 4 shows a schematic cross-sectional view of an open front refrigerated case having a plurality of air bands circulated in the same direction during a refrigeration cycle.

In the preferred arrangement shown in FIGS. 4 and 5, a third air band, designated by arrows C, is maintained substantially across the open front of the display case. This third air band is composed of ambient air drawn, by means of a plurality of fans 178, preferably the same in number as fans 164 and 174, into a plenum chamber 180 defined by a housing 182 located on the exterior of the cabinet 120. Plenum chamber 180 opens into an outlet 184 which is covered by an extension 176*a* of outlet grille 176 to direct air through outlet 184 and downwardly across the open front of the display case, as indicated by arrows C. This third air band is not recirculated through the case, but exits outwardly of front panel 148 into the aisle area of the store, so that the ambient air can warm the aisle for customer comfort, as well as adding inertia to the total air curtain formed by the primary and secondary air bands.

During the ambient air defrost cycle (FIG. 5) it is desired to draw ambient air into the secondary air band and to reverse the air flow through conduit 172. This is accomplished by reversing the direction of fans 174 so that an ambient air band flows through conduit 172 and comes into contact with evaporator coils 146 as further detailed with respect to the description of FIG. 8, below. An ambient air band is thus drawn into plenum chamber 168 and circulated by the propulsive force of fans 174 through conduit 172 in the direction opposite to the air flow through conduit 172 during the refrigeration cycle.

Referring more specifically to FIGS. 6 and 7 separator panel 150 has a diverter assembly 186 formed therein comprising openings 188 located below inlet grille 152 to permit communication between conduits 158 and 172. Cover plates 190, having an arcuate cross-section and extending transversely on either side of panel 150 substantially across each of conduits 158 and 172, cover the upper part of openings 188. A plurality of such diverters are located across the entire width of panel 150.

The purpose of the diverter assembly is to provide an open path for ambient air flowing through conduit 172 in the direction of arrows D to be drawn into and through conduit 158. Fans 164, located downstream of the diverter assembly create sufficient suction so that during the defrost cycle, with air flowing in the direction of arrows D, a substantial portion of the ambient air flowing through conduit 172 is drawn into and through conduit 158.

It will be noted that during the defrost cycle, air flowing through primary conduit 158 flows in the same direction as during the refrigeration cycle. This permits maintenance of a primary defrost air band across the access opening 132 of display section 122, which, even though it is warmed by the incoming ambient air from conduit 172 through the diverter assembly, is still sufficiently cool to inhibit moisture-laden ambient room air from entering display space 122 directly.

Maintenance of the primary defrost air band during the defrost cycle also aids in directing the remainder of the ambient air flowing through conduit 172 to be drawn into conduit 158 adjacent grille 152, as indicated by arrows D′ in FIG. 7. In this way, a substantial portion of the ambient air flowing through conduit 172 is diverted into and through conduit 158.

During the defrost cycle, the flow of refrigerant through the refrigerating coils is halted and the warmer ambient air drawn in through the access opening 132 by fans 174 and through conduit 172 and into conduit 158, flows over and through the refrigeration coils 146 to melt any ice, snow or frost formed thereon.

Also during the defrost cycle, a portion of the ambient air flowing out of conduit 180 is diverted into conduit 172 through outlet 174 by the suction created by fans 174. This increases the total amount of ambient air flowing through conduit 172 and conduit 158 for defrosting coils 146.

It will be seen that the transition from the refrigeration cycle to the defrost cycle requires only that the supply of refrigerant to coils 146 be halted during the defrost cycle and that the secondary conduit fans 174 be reversed.

An advantage of this embodiment is that the air curtain formed by the primary defrost air band across the access opening of the display section 122 is maintained at all times to inhibit infiltration of moisture-laden ambient room air into the display section, thereby cutting down on the amount of frost which would otherwise accumulate during a refrigeration cycle due to the presence of ambient air in the display space 122. This also reduces product thawing and the resulting quality and health problems thereof.

Figure 8:
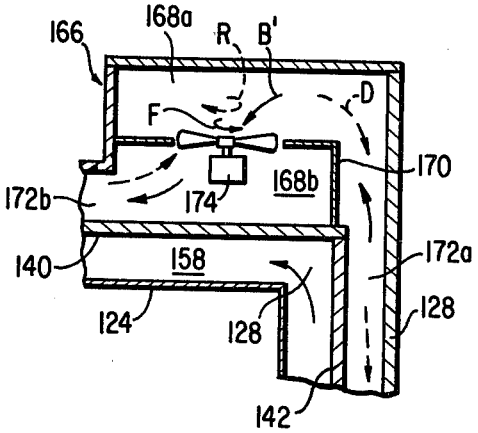
FIG. 8 shows a detailed view of the secondary air conduit circulation fan used in the case illustrated in FIGS. 4 and 5.

FIG. 8 shows, in detail, the secondary conduit plenum 168 and reversible fan 174. During a refrigeration cycle motor-driven fan 174 operated in a forward direction, F, to propel the secondary air band, B′, through conduit 172. In a defrost cycle fan 174 operates in a reverse direction, R, to propel the secondary air band, D, in the opposite direction through conduit 172.

In the defrost cycle, fans 174 are switched, either manually or by conventional thermostatic control means, to rotate in the opposite direction, as indicated by the dotted line arrow R.

In this arrangement, a negative pressure head is maintained in conduit section 168*b* to draw ambient air into secondary air band outlet 175 to flow through conduit 172 in the reverse direction. In the defrost condition, primary air fans 164 help draw the reverse flowing ambient air into conduit 158 to propel it through coils 146 to exit from primary conduit outlet 160.

Figure 9:
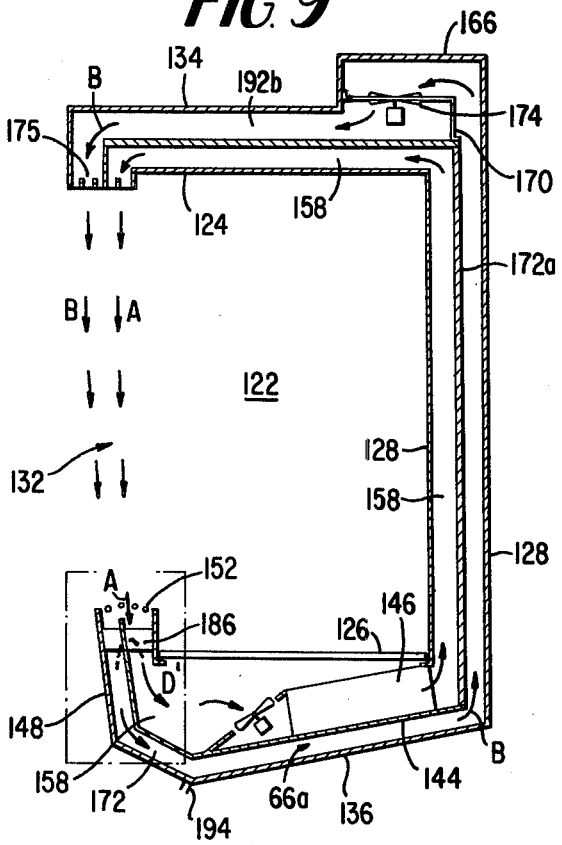
FIG. 9 shows a schematic cross-sectional view of a modification of the refrigerated case of FIGS. 4 and 5.

FIG. 9 shows a somewhat simpler embodiment of the case 120 shown in FIGS. 4–8, wherein the ambient air band housing 182 and fan 178 are omitted. Consistent numeral identification has been used where possible. This case then operates in a refrigeration cycle with two air bands A and B as shown. During defrost the ambient air is drawn into opening 175 at the top front of the secondary conduit 172 and propelled by fans 174 to the diverter assembly 186 described above. The diverted ambient air band D' then provides low cost heat for the defrosting of evaporator coils 146 and conduit 158.

In case 120 bottom drain 192 provides drainage for the primary air conduit 158 and bottom drain 194 provides the same for secondary conduit 172.

Referring to FIGS. 10–14, an open front refrigerated display case 200 constructed in accordance with the present invention has top, bottom, rear and side walls along with a partial front wall. All of these outer walls are appropriately insulated. Front wall 202 has an access opening 204. Positioned above bottom wall 206 are a plurality of shelves 208–216. The spacing between shelf 208 and bottom wall 206 is large enough to enable a series of fans 218 and if desired the refrigeration coils 220, which are described later herein, to be arranged within that space. Extending along the top wall, rear wall and bottom wall is an air conduit 222. Arranged within air conduit 222 is at least one fan 218. While only one fan is illustrated, typically for refrigerated cases that are eight feet long, two fans are employed and for cases twelve feet long there are three fans. The number of fans merely depends on the length of the case and the size of the fans but have no bearing upon the scope of the present invention. All the fans arranged within air conduit 222 are reversible fans capable of being driven for propelling air in either direction.

Air conduit 222 has an opening 224 at the top of the refrigerated display case. A directional control air grille 226 is mounted across opening 224. Grille 226 is preferable constructed so as to assist in directing air leaving air conduit 222 through opening 224 towards opening 228 on the opposite side of access opening 204 of the display case. At the opposite side of the display case across opening 228 there is integrally formed an air flow ejector means 230, shown in detail in FIG. 12, which has an air grille associated therewith. Air flow ejector means 230 is specially arranged and configured to control the air band direction emitted during defrost. In addition to helping in controlling the direction of flow of the defrost air band leaving opening 228, the air grille 226 also protects the opening from various debris, such as trash, keys and coins.

Refrigeration coils 220 are positioned within air conduit 222 at a location either adjacent to or above fan 218. In a conventional manner, when the display case is operated in a refrigeration cycle, the air passing through refrigeration coil 220 is cooled, or refrigerated. The extent to which air is cooled depends on the use to which the display case is to be put. If the display case is to serve for holding frozen food, then the air must be sufficiently cooled so as to maintain the interior of the case below 32° F. If, however, the display case is used for storage of non-frozen products, such as dairy products, then a temperature slightly in excess of 32° F. can be maintained. The term refrigeration, however, as used herein is intended to cover both types of systems.

Figure 10:
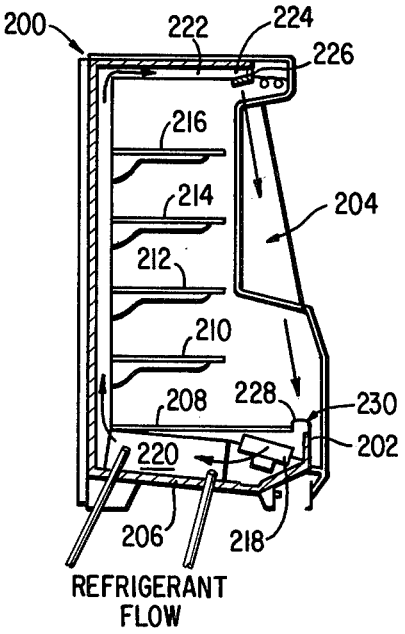
FIG. 10 is a schematic cross-sectional view of a refrigerated case having an air ejector mechanism according to the present invention operating in a refrigeration cycle.
Figure 11:
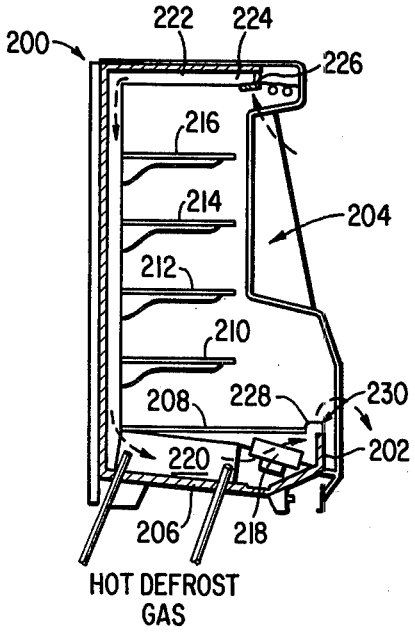
FIG. 11 shows the case of FIG. 10 when operated during a defrost cycle.

Turning now to the structural arrangement in the area of opening 228, as shown in FIGS. 10 and 11, the air flow ejector means 230 located in the top part of the lower portion of front wall 202 within air conduit opening 228 causes the defrost air to be directed towards the outside of display case 200. This air flow control means is detailed in the description of FIG. 12, below, and functions to direct air leaving conduit 222 through opening 228 during a defrost operation in a direction away from the display case as shown by the arrows in FIG. 11.

During the refrigeration cycle of operation of the display case, air is circulated through air conduit 222 by fan 218 in a forward direction towards and through refrigeration coils 220, which are activated for cooling. The volume of air flow during refrigeration is between 1000 and 1200 cfm. The air is cooled when passing through refrigeration coils 220. The cooled air then travels through the remaining portion of conduit 222. As the air reaches opening 224 in conduit 222, it is forced out through air louver grille 226 in a direction towards opening 228. In this manner, a curtain of cooled air is established across access opening 204 of the display case. The cooled air serves to refrigerate the products in the display case and also separate the warmer ambient air outside of the display case from the cooler air inside of the display case.

The air emitted through grille structure 226 and travelling across the access opening is received into opening 228 in the air conduit. This air is then drawn back into air conduit 222 by suction force established by fan 218. Thus, during the refrigeration cycle a continuous band of cooled air is circulated by fan 218 through the display case. The direction of travel of such air along the air band is illustrated in FIG. 10.

Turning now to the defrost cycle, the air flow during this cycle of operation is illustrated in FIG. 11. In any one of different conventional manners, the display case can be thermostatically or otherwise controlled so as to switch between the refrigeration cycle and the defrost cycle. By one such technique, the switching can occur when a certain degree of frost buildup is detected on the refrigeration coils. Another possible alternative is to switch the operation of the display case from a refrigeration cycle to a defrost cycle at set time intervals.

During the defrost cycle, the operation of fan 218 is reversed so as to propel air in a reverse direction through refrigeration coils 220. When the fan is operated in this mode, air passes along conduit 222 out through opening 228. The air upon exiting from opening 228 is diffused and falls to the floor outside of the case. As the air leaving conduit 222 during the defrost cycle passes through the air flow ejector means 230, the path of air curves into an arc directed up and away from display case 200. Thus, in this mode of operation, there is no air curtain established across the access opening of display case 200 and also no continuous air band established through the display case. The volume of air flow during the defrost operation is between 800 and 1100 cfm and should be less than the air flow during refrigeration.

As air is propelled out of conduit 222 through opening 228, a partial vacuum is established within the air conduit so as to cause air to be sucked into the conduit through top opening 222. Since there is no air curtain in existence across the top of the display case during the defrost cycle, the air sucked into the conduit through opening 222 is drawn from the ambient air surrounding the display case. Since such ambient air is of a higher temperature than the refrigerated air during the refrigeration cycle, such ambient air serves to defrost any frost buildup within the system, including, in particular, on the refrigeration coils. The direction of air flow during the defrost cycle is shown by the arrows in FIG. 11. In this modification the refrigerated air from the previous refrigeration cycle tends to remain on product display shelves 208–216 since there is no flow of ambient air directed thereover. The difference in air density between the ambient air and this contained refrigerated air mass does however permit some convection air flow in a downward direction. Thus defrost action in such single band open front cases should be of only short duration of 10 to 15 minutes. The combination of the hot defrost gas flow through evaporator coils 220 cooperate to permit such defrost action in display cases of the type illustrated in FIG. 11.

Referring now to FIG. 12, a detailed view of the conduit openings 228 of FIGS. 10–11 is shown with an air flow direction chamber 232 integrally formed in the upper portion of the air conduit 222. The configuration of this chamber 232 is that diagrammatically illustrated in preferred FIGS. 10 and 11. The air conduit 22 is formed between front wall 202 and interior conduit wall 234. The configuration of chamber 232 is such that an enlarged air flow space 236 is positioned to the outward side of the central plane 238 which extends vertically within conduit 222.

An air grille 240 is positioned over air conduit opening 228 and the chamber 232 and is connected to the upper edge of interior conduit panel 234 by a first vertical section 242 having air flow apertures 244 therein for permitting throughflow during a refrigeration cycle. An upper arcuate non-perforated, solid section 246 is connected to the upper edge of vertical section 242 and extends outwardly toward front wall 204. A perforated air ejector surface 248 is connected between the non-perforated section 246 and the inner surface of front wall 202. The position and configuration of ejector surface 248 is such that a plane 250 normal or perpendicular to at least a portion thereof extends outwardly away from the display case 200 and forms an angle of at least about 20° with the vertical central plane 238 located in conduit 222. During the defrost cycle the defrost ambient air is forcibly ejected from conduit 222 by fan 218 and flows upwardly through opening 228. Due to the air flow direction chamber 232 the air direction is changed from the upward vertical flow path to an outward directed path which has, then, a significant horizontal velocity vector associated therewith. The flow direction is then roughly parallel to the plane 250 and the air is forced through air ejector surface 248 so that it flows upward and out of the display case 200. In this manner the ejector surface 248 cooperates with the defrost air band to maintain a significant horizontal velocity vector which is directed outwardly. The portion of the ejector surface which cooperates with the air band can be curvi-linear; however, a planer surface is preferred as shown in FIG. 12. Both surface configurations permit the outwardly directed position of plane 250.

FIG. 13 shows a vector diagram for the resulting air flow path. The principal flow vector $V_l$ can be broken into the horizontal velocity component vector $V_h$ and the vertical vector $V_v$. The air flow control means formed by the conduit 222, opening 228, chamber 232, and air grille 240 is such that a significant horizontal velocity vector $V_h$ is imparted to the air band which then causes the air stream to be ejected by mass momentum through the ejector surface 248 outwardly away from the display case product storage space. The angle, $\theta$, formed by the complementary vertical vector $V_v$ is at least 20° as disclosed above.

Returning to FIG. 12, a bumper rail 252 can be attached to the outer surface of front wall 202 and trim members 254 and 256 can be arranged as well to form a decorated display case front wall. A lip arrangement 258 can also be formed over the top of the front wall which can vary slightly in its vertical position. The air flow apertures in air grille 240 can preferably be rectangular of 7/16 inch by ¾ inch sizes spaced in both directions on 1 inch centerlines, although circular or other shaped openings can also be used. A more highly perforated aperture pattern that this can be used for the ejector surface 248 if desired.

It will be noted that the arcuate non-perforated air grille 246 substantially overlies the upper part of the conduit 222, whereas the perforated air ejector surface 248 overlies the air flow direction chamber 232.

During the defrost cycle the dominant air flow is through the apertures in the ejector surface 248 due to the interaction of the defrost air band with the flow direction chamber 232. A small "leakage" flow through the apertures of the first vertical section 242 can occur, but is controlled to a low level by the outwardly directed horizontal velocity vector, $V_h$, so that substantially all air leaving the conduit 222 flows away from the case 200 during substantially the entire defrost cycle. Also, products stored on shelf 206 will further reduce any "leakage" flow which migh occur.

FIG. 14 shows another embodiment of an air flow control means 260 which is operationally similar to the ejector means 230 in FIGS. 10–12. In this modification, front wall 202 of a refrigerated case has a rail 262 which extends outwardly away from the front thereof and the top portion of front wall 202 is formed with an air flow slope 264. As defrost air D (shown by the dotted arrows) is propelled through the air conduit 222 the upward and outward flow of the defrost air band is controlled by the air flow restriction baffle 266 which has the effect of reducing the flow area 268 to approximately 60% of the cross-sectional area available for air flow in conduit 222. This reduced flow area 268 produces the effect described above with regard to FIGS. 1–3 of increasing the linear air velocity of the defrost air band by approximately 66% which then increases the momentum of the defrost air D sufficiently to expel the same outward and away from the access opening 268. A perforated air grille 270 is placed over the conduit opening 268 and is formed with a downwardly directed front skirt 272 which abuts the rail 262 and proceeds downwardly parallel to the outwardly sloped wall 202.

The flow restriction baffle 266 is effective for increasing the linear velocity of the defrost air band D sufficient so that the same is ejected outward away from the access opening 204 of refrigerated case 200 in the same manner as the ejection of the defrost air band D in FIGS. 2 and 3.

The combination of the ambient air defrost described with respect to FIGS. 10–14 cooperates with the defrost action imparted by the hot gas defrost during a defrost cycle to provide a quick defrost of the refrigerated cabinet 200. During the defrost cycle the refrigerant flow in the evaporator coils 220 is interrupted and hot compressor gas is taken through the evaporator coils in order to defrost the same.

In the above-described refrigerated display cases, defrost means are provided for enabling the supply of hot refrigeration gas to the refrigeration coils and the formation of a unidirectional ambient air band for movement through the air conduit in which the refrigeration coil is located during the entire defrost cycle. A defrost air band is then formed by heat exchange with the refrigeration coils. The unidirectional ambient air band the hot refrigeration gas cooperate to form a quick defrost for the refrigerated cabinets. The defrost means employed enables the unidirectional ambient air band and the defrost air band formed within the cases to flow into and out of the air conduit, respectively, in a manner to exclude ambient air from entering the product display space through the access opening of the display cabinets. In the display cases illustrated in FIGS. 2 and 11 the defrost means comprises the hot gas defrost and the ambient air bands C which flow in a unidirectional manner through the air conduit and form a defrost air band upon contact with the defrosting of the refrigeration coils. Thereafter, the defrost air band is ejected away from the access opening of the cases so that the air is not forced into contact with the products contained within the product display space. In the case illustrated in FIG. 5 the defrost means comprises the hot gas forced through the refrigeration coils 146 and the unidirectional ambient air band which flows in the same direction during the entire defrost cycle and forms a defrost air band upon contact with and defrosting of the refrigeration coils. Thereafter, the defrost air band forms a protective air guard band across the access opening of the display case in order to positively prevent entry of ambient air into the display space.

The term "unidirectional" as used herein with respect to the ambient air band defines an air flow which occurs in the same direction with respect to the air conduit walls through which the air flows during the entire defrost cycle. In some cases, for example as illustrated in FIG. 5, the unidirectional ambient air band flow pattern is serpentine but always flows in the same direction during the entire defrost cycle with respect to those portions of the air conduits through which the ambient air band is propelled.

The hot gas defrost submeans of the defrost means can be provided for use in the refrigeration coils by a number of known systems. The gas flow can be continuous or can be controlled for intermittent flow during the defrost cycle so that a cyclical heat transfer function is established within the refrigeration coils. A hot gas system is disclosed in U.S. Pat. No. 4,286,437 issued to the inventor hereof and a co-inventor. The disclosure of this patent is hereby incorporated by reference as though fully set forth herein.

The present invention may be embodied in other specific forms without departing from the spirit or essential characteristics thereof. The present embodiments are presented merely as illustrative and not restrictive, with the scope of the invention being indicated by the attached claims rather than the foregoing description. All changes which come within the meaning and range of equivalency of the claims are therefore intended to be embraced therein.

What is claimed is:

1. In a refrigerated display case having a product display case and an unimpeded access opening thereto and at least one air conduit formed between front, bottom, rear and side walls and spaced inner panels, and having a refrigeration coil means located within said air conduit; and an air moving means for propelling an air band in a first direction through said air conduit during a refrigeration cycle; the improvement comprising:

defrost means for enabling the supply of hot refrigerant gas to said refrigeration coil means and the formation of a unidirectional ambient air band for movement through said air conduit and about said refrigeration coil means during the entire defrost cycle and the formation of a defrost air band by heat exchange with said refrigeration coil means, said unidirectional ambient air band adapted for defrosting said air conduit and said refrigeration coil means simultaneously with the defrost by said hot refrigeration gas, said defrost means including direction means for defrost air located adjacent to said access opening and at the discharge end of said air conduit during a defrost cycle for enabling said defrost air band to be expelled outwardly away from said display space, and said defrost means enabling said unidirectional ambient air band and said defrost air band to flow into and out of said air conduit in a manner to prevent ambient air from being forced into said product display space through said access opening.

2. The improvement according to claim 1, wherein said direction means comprises ejector means for enabling said defrost air band to be expelled outwardly away from said display space of said case in order to avoid comingling with ambient air and contact thereof with products stored in said display space.

3. The improvement according to claim 2, wherein said ejector means comprises an air flow restriction baffle positioned within said air conduit adjacent to the discharge end of said air conduit when said cabinet is operated in a defrost cycle, said air flow restriction baffle operable to increase the velocity of the air band in said conduit during a defrost cycle sufficiently to expel the defrost air band substantially out of said cabinet and away from said display space.

4. The improvement according to claim 2, wherein said display case is constructed with an open top which forms said access opening and wherein said ejector means is located adjacent to a front wall of said cabinet.

5. The improvement according to claim 3, wherein said air flow restriction baffle is integrally formed in a terminal portion of said air conduit.

6. The improvement according to claim 1, wherein a second air conduit is positioned about the outside of the first air conduit for enabling circulation of a second air band therein.

7. The improvement according to claim 1, wherein an air grille is positioned adjacent to said direction means and wherein said defrost air band propelled out of said display case by said direction means passes through said air grille prior to expulsion from said case and away from said display space during a defrost cycle of operation.

8. The improvement according to claim 2, wherein at least one heater element is positioned adjacent to said ejector means to prevent the formation of moisture condensate thereon and is operable for increasing the temperature and velocity of the ejected defrost air band.

9. The improvement according to claim 8, wherein said heater element comprises at least one hot refrigeration gas line.

10. The improvement according to claim 3, wherein a terminal portion of said air flow restriction baffle is formed along a plane established by said access opening, and wherein said baffle also functions to guide said defrost air band out of said cabinet.

11. The improvement according to claim 3, wherein said air flow baffle formed a restricted air flow cross-sectional area which is reduced to at least about 50% to 90% of the cross-sectional area of said air conduit immediately upstream of said baffle during the defrost cycle.

12. The improvement according to claim 2, wherein said defrost ambient air band linear velocity is increased by about 66% above the velocity of the air band during the refrigeration cycle.

13. The improvement according to claim 2, wherein said ambient air band volumetric flow rate in the defrost cycle is 25% to 50% lower than the flow of said air band during a refrigeration cycle.

14. The improvement according to claim 3, wherein said air flow restriction baffle forms a restricted air flow cross-sectional area which is reduced to about 80% of the cross-sectional area of said conduit immediately upstream of said baffle during the defrost cycle.

15. The improvement according to claim 14, wherein said defrost air band linear velocity is increased by about 40%.

16. The improvement according to claim 2, wherein an air grille is positioned in the flow path of the defrost air band downstream from said ejector means during a defrost cycle, and wherein said air grille enables through-flow of said defrost air band during a defrost cycle in a vertically-oriented direction and flow of a refrigerated air band during a refrigeration cycle in a horizontally-oriented direction.

17. The improvement according to claim 16, wherein the flow direction of said defrost and said refrigerated air bands are at angles of about 90° to 140° of one another.

18. The improvement according to claim 1, wherein the volumetric flow rate of said defrost air band in the defrost cycle is lower than the volumetric flow rate of said air band in the first direction during a refrigeration cycle.

19. The improvement according to claim 1, wherein said air conduit consists of a first conduit and said defrost means includes a second air conduit formed within said refrigerated case and disposed about said first air conduit, said first and second air conduits having condensate drains at the bottom thereof, an air circulating means mounted in said second air conduit for enabling the supply of said unidirectional ambient air band to said first air conduit to said refrigeration coil means during a defrost cycle, and said ambient air band enabling the transfer of heat to both of said condensate drains prior to passage through said refrigeration coil means.

20. The improvement according to claim 19, wherein said air circulating means mounted in said second air conduit is operable for selectively propelling said unidirectional ambient air band during a defrost cycle of operation and for propelling a secondary air guard band in the same direction as the air band in said first conduit during a refrigeration cycle of operation, said defrost means enabling the flow of said unidirectional ambient air band first in said second air conduit and then in said first air conduit during a defrost cycle of operation.

21. The improvement according to claim 20, wherein said defrost means includes air guidance means for deflecting at least a portion of said unidirectional ambient air band from said second air conduit into said first air conduit during a defrost cycle of operation.

22. The improvement according to claim 21, wherein said guidance means deflects substantially all of said unidirectional ambient air band into said first air conduit.

23. The improvement according to claim 19, wherein said air circulating means mounted in said second air conduit includes at least one bi-directional air fan for propelling said ambient air band in a first direction during a refrigeration cycle and in an opposite direction during a defrost cycle.

24. The improvement according to claim 19, wherein said defrost means provides for the intermittent flow of hot refrigerant gas in said refrigeration coils during a defrost cycle.

25. The improvement according to claim 2, wherein said refrigerated display case has a top access opening therein.

26. The improvement according to claim 2, wherein said display case has a front access opening therein.

27. The improvement according to claim 1, wherein said case is constructed with an open front wall which forms said access opening and wherein said ejector means is located near the bottom of said access opening.

28. A refrigerated display case having a product display space and an unimpeded access opening therein and at least one air conduit formed between front, bottom, rear and side outer walls and spaced inner panels, and having a refrigeration coil means located within said air conduit; comprising air moving means for propelling an air band in a first direction through said air conduit during a refrigeration cycle; defrost means for enabling the supply of hot refrigeration gas to said refrigeration coil means and the formation of a unidirectional ambient air band for movement through said air conduit and about said refrigeration coil means during the entire defrost cycle and to form a defrost air band by heat exchange with said refrigeration coil means, said unidirectional ambient air band adapted for defrosting said air conduit and said refrigeration coils means simultaneously with the defrost of said hot refrigeration gas, said defrost means including direction means for defrost air located adjacent to said access opening and at the discharge end of said air conduit during a defrost cycle for enabling said defrost air band to be expelled outwardly away from said display space, and said defrost means enabling said unidirectional ambient air band and said defrost air band to flow into and out of said air conduit in a manner to prevent ambient air from being forced into said product display space through said access opening.

29. The display case according to claim 28, wherein said direction means comprises ejector means for enabling said defrost air band to be expelled outwardly away from said display space of said case in order to avoid comingling with ambient air and contact thereof with products stored in said display space.

30. The display case according to claim 29, wherein said display case has a top access opening therein.

31. The display case according to claim 28, wherein said display case has a front access opening therein.

32. The display case according to claim 29, wherein said ejector means comprises an air flow restriction baffle positioned within said air conduit adjacent to the discharge end of said air conduit when said cabinet is operated in a defrost cycle, said air flow restriction baffle operable to increase the velocity of the air band in said conduit during a defrost cycle sufficiently to expel the defrost air band substantially out of said cabinet and away from said display space.

33. The display case according to claim 30, wherein said defrost means includes ejector means for enabling said defrost air band to be expelled outwardly away from said display space of said case and wherein said ejector means is located adjacent to the front wall of said cabinet.

34. The display case according to claim 32, wherein said air flow restriction baffle is integrally formed in a terminal portion of said air conduit.

35. The display case according to claim 28, wherein a second air conduit is positioned about the outside of the first air conduit for enabling circulation of a second air band therein.

36. The display case according to claim 29, wherein at least one heater element is positioned adjacent to said ejector means to prevent the formation of moisture condensate thereon and is operable for increasing the temperature and velocity of the ejected defrost air band.

37. The display case according to claim 36, wherein said heater element comprises hot refrigeration gas lines.

38. The display case according to claim 32, wherein a terminal portion of said air flow restriction baffle is formed along a plane which passes through and extends away from the plane established by said access opening, and wherein said baffle also functions to guide said defrost air band out of said cabinet.

39. The display case according to claim 29, wherein the linear velocity of said defrost ambient air band is increased by about 66% above the velocity of the air band during the refrigeration cycle.

40. The display case according to claim 29, wherein the volumetric flow rate of said ambient air band in the defrost cycle is 25% to 50% lower than the flow of said air band during a refrigeration cycle.

41. The display case according to claim 29, wherein an air grille is positioned in the flow path of the defrost air band downstream from said ejector means during a defrost cycle, and wherein said air grille enables through-flow of said defrost air band during a defrost cycle in a vertically-oriented direction and flow of a refrigerated air band during a refrigeration cycle in a horizontally-oriented direction.

42. The display case according to claim 41, wherein the flow direction of said defrost and said refrigerated air bands are at angles of about 90° to 140° of one another.

43. The display case according to claim 28, wherein the volumetric flow rate of said defrost air band in the defrost cycle is lower than the volumetric flow rate of said air band in the first direction during a refrigeration cycle.

44. The display case according to claim 28, wherein said air conduit consists of a first conduit and said defrost means includes a second air conduit formed within said refrigerated case and disposed about said first air conduit, said first and second air conduits having condensate drains at the bottom thereof, an air circulating fan mounted in said second air conduit for enabling the supply of said unidirectional ambient air band to said first air conduit to said refrigeration coil means during a defrost cycle, and said ambient air band enabling the transfer of heat to both of said condensate drains prior to passage through said refrigeration coil means.

45. The display case according to claim 44, wherein said air circulating means mounted in said second air conduit is operable for selectively propelling said unidirectional ambient air band during a defrost cycle of operation and for propelling a secondary air guard band in the same direction as the air band in said first conduit during a refrigeration cycle of operation, said defrost means enabling the flow of said unidirectional ambient air band first in said second air conduit and then in said first air conduit during a defrost cycle of operation.

46. The display case according to claim 45, wherein said defrost means includes air guidance means for deflecting at least a portion of said unidirectional ambient air band from said second air conduit into said first air conduit during a defrost cycle of operation.

47. The display case according to claim 28, wherein said direction means comprises ejector means for enabling said defrost air band to be expelled outwardly froms aid display space of said case and wherein said ejector means is located near the bottom of said access opening.

48. The display case according to claim 28, wherein an air grille is positioned adjacent to said direction means and wherein said defrost air band propelled out of said display case by said direction means, passes through said air grille prior to expulsion from said case and away from said display space during a defrost cycle of operation.

49. A method of defrosting a refrigerated display case having a product display space and an unimpeded access opening therein and at least one air conduit formed between front, bottom, rear and side outer walls and spaced inner panels, and having a refrigeration coil means located within said air conduit; an air moving means for propelling an air band in a first direction through said air conduit during a refrigeration cycle; said method comprising the steps of:

terminating the refrigeration cycle by interrupting the flow of refrigerant through the refrigeration coil means;

supplying hot refrigeration gas to said refrigeration coil means;

forming a unidirectional ambient air band for movement through the air conduit and about the refrigeration coil means;

propelling the unidirectional ambient air band about the refrigeration coil means during the entire defrost cycle in order to defrost the same and to form a defrost air band by heat exchange therewith;

flowing the unidirectional ambient air band into the air conduit and the defrost air band out of the air conduit in a manner to prevent ambient air from being forced into the product display space through the access opening; expelling the defrost air band outwardly away from the display space of the display case in order to avoid comingling with ambient air and contact thereof with products stored in the case by forming direction means for defrost air located adjacent to the access opening and at the discharge end of said air conduit during a defrost cycle for enabling said defrost air band to be expelled outwardly from said display space.

50. The method according to claim 49, including the additional step of:

directing the defrost air band downwardly across the access opening of an open front display case in order to positively exclude contact of ambient air with products stored therein.

51. The method according to claim 49, including the additional step of:

supplying the unidirectional ambient air band to the air conduit by movement of ambient air through a second air conduit.

52. The method according to claim 51, wherein said supplying step is carried out so that the direction of flow of the ambient air band in the air conduit is opposite to the direction of movement of the ambient air flowing through the second air conduit.

53. The method according to claim 52, wherein a guard air band is propelled through the second air conduit during the refrigeration cycle.

54. The method according to claim 51, 52 or 53, including the additional step of:

directing the defrost air band downwardly across the access opening of an open front display case in order to positively exclude contact of ambient air with products stored therein.

55. The method according to claim 49, wherein said supplying of hot refrigerant gas to said coil means occurs intermittently during a defrost cycle.

56. In a refrigerated display case having a product display space and an unimpeded access opening thereto and at least one air conduit formed between front, bottom, rear and side walls and spaced inner panels, and having a refrigeration coil means located within said air conduit; and an air moving means for propelling an air band in a first direction through said air conduit during a refrigeration cycle; the improvement comprising:

defrost means for enabling the supply of hot refrigerant gas to said refrigeration coil means and the formation of a unidirectional ambient air band for movement through said air conduit and about said refrigeration coil means during the entire defrost cycle and the formation of a defrost air band by heat exchange with said refrigeration coil means, said unidirectional ambient air band adapted for defrosting said air conduit and said refrigeration coil means simultaneously with the defrost by said hot refrigeration gas, said defrost means enabling said unidirectional ambient air band and said defrost air band to flow into and out of said air conduit in a manner to prevent ambient air from being forced into said product display space through said access opening, said defrost means including ejector means for enabling said defrost air band to be expelled outwardly away from said display space of said case, in order to avoid comingling with ambient air and contact thereof with products stored in said display space, and said cabinet having an open front wall which forms said access opening and wherein said ejector means is located near the bottom of said access opening.

57. A refrigerated display case having a product display space and an unimpeded front access opening therein and at least one air conduit formed between front, bottom, rear and side outer walls and spaced inner panels, and having a refrigeration coil means located within said air conduit; comprising air moving means for propelling an air band in a first direction through said air conduit during a refrigeration cycle; defrost means for enabling the supply of hot refrigeration gas to said refrigeration coil means and the formation of a unidirectional ambient air band for movement through said air conduit and about said refrigeration coil means during the entire defrost cycle and to form a defrost air band by heat exchange with said refrigeration coil means, said unidirectional ambient air band adapted for defrosting said air conduit and said refrigeration coil means simultaneously with the defrost of said hot refrigeration gas, said defrost means enabling said unidirectional ambient air band and said defrost air band to flow into and out of said air conduit in a manner to prevent ambient air from being forced into said product display space through said access opening, and said defrost means including ejector means for enabling said defrost air band to be expelled outwardly away from said display space of said case in order to avoid comingling with ambient air and contact thereof with products stored in said display space and wherein said ejector means is located near the bottom of said access opening.

* * * * *

UNITED STATES PATENT AND TRADEMARK OFFICE

CERTIFICATE OF CORRECTION

PATENT NO. : 4,449,374

DATED : May 22, 1984

INVENTOR(S) : Fayez F. Ibrahim

It is certified that error appears in the above-identified patent and that said Letters Patent is hereby corrected as shown below:

Column 5, line 36, change "77" to --7-7--; and

, line 52, change "fo" to --of--.

Column 7, line 49, change "volumn" to --volume--.

Column 14, line 57, change "222" to --224--.

Column 22, line 5, insert --away-- after "outwardly"; and

, line 6, change "froms aid" to --from said--.

Signed and Sealed this

*Eleventh* Day of *December 1984*

[SEAL]

*Attest:*

GERALD J. MOSSINGHOFF

*Attesting Officer*

*Commissioner of Patents and Trademarks*